US005517775A

United States Patent [19]

Kurtz

[11] Patent Number: 5,517,775

[45] Date of Patent: May 21, 1996

[54] EDGING APPARATUS FOR CANVAS FRAME

[76] Inventor: William Kurtz, Tiopa Corporation, 24 Summit Ave., Mill Valley, Calif. 94941

[21] Appl. No.: 323,261

[22] Filed: Oct. 14, 1994

[51] Int. Cl.[6] ..... D06C 3/08; A47G 5/00

[52] U.S. Cl. ..... 38/102.91; 160/378; 160/404

[58] Field of Search ..... 38/102, 102.1, 38/102.2, 102.91; 40/603, 574, 611; 101/127.1; 160/378, 371, 369, 379, 380, 382, 383, 404; 49/504, 505; 26/71; 248/441.3, 903; 84/414, 415, 421, 411 A, 420

[56] References Cited

U.S. PATENT DOCUMENTS

| | | | |
|---|---|---|---|
| 928,598 | 7/1909 | Gibbs | 38/102.2 |
| 1,574,364 | 2/1926 | Carlson | 38/102.2 |
| 2,456,225 | 12/1948 | Thomas | 38/102.91 |
| 3,529,653 | 9/1970 | Fey, Jr. | 160/378 |
| 3,830,278 | 8/1974 | Packer | 40/158.1 |
| 3,841,008 | 10/1974 | Cusick | 38/102.91 |
| 4,179,830 | 12/1979 | Lamb | 38/102.5 |
| 4,279,087 | 7/1981 | Crawford | 40/158.1 |
| 4,947,561 | 8/1990 | Delacroix et al. | 38/102.91 |
| 4,991,329 | 2/1991 | Wilson | 40/156 |
| 5,015,034 | 5/1991 | Kindig et al. | 160/380 |
| 5,115,584 | 5/1992 | Lucchetti | 38/102.91 |
| 5,133,140 | 7/1992 | Frey | 38/102.91 |

FOREIGN PATENT DOCUMENTS

| | | | |
|---|---|---|---|
| 2667541 | 4/1992 | France | 38/102 |

*Primary Examiner*—Ismael Izaguirre
*Attorney, Agent, or Firm*—Douglas E. White; Acronational Law Firm

[57] ABSTRACT

An extruded longitudinally-pliable but uprightly rigid plastic edging strip may be affixed to the side of the outer edge of a shaped back mounting panel. The tall thin cross section of the planar strip allows its longitudinal axis to bend sideways to follow the curved edge of the shaped backing. Once in place, canvas or like fabric may be stretched over the edging strip and lie in a horizontal plane that is vertically elevated from the horizontal plane of the backing panel, whereupon the canvas will not contact the backing panel. Suitably shaped injection-molded thrust-support brackets placed at spaced horizontal intervals help stiffen the edging strip against the inwardly directed force of the stretched canvas. Alternately, the cross-section of the edging strip can be extruded in a shape which inherently resists inward deformation, so that the need for separate brackets is eliminated.

13 Claims, 4 Drawing Sheets

EDGING APPARATUS FOR CANVAS FRAME

FIELD OF THE INVENTION

This invention relates to stretcher frames for mounting artists' canvases, more particularly to an edging strip for raising the canvas up off the plane of the strecher frame or off the back mounting panel of curvilinear paintings.

BACKGROUND OF THE INVENTION

Artists' canvases ordinarily are stretched on frames comprised of four straight wooden boards ("stretcher boards") secured together in a rectangle, over the top of which the canvas is pulled taut and fastened along the edges. Occasionally, the internal outline of one or more stretcher boards becomes visible when the painting is hung. These "ghost" shadows are unsightly and detract from the viewer's appreciation of the artwork.

Typically, this occurs in one of two ways. Either the canvas sags back against the frame when hung for display and shadows temporarily reveal the internal outline of the stretcher, or, as the artist creates the painting, he or she pushes too hard on the brush, leaving permanent marks as the brush drags over the inner edge of the wood (in the manner that charcoal rubbings are made of works formed in bas-relief).

The common method of preventing these effects is to raise the outer edge of each stretcher slightly in order to lift the canvas off the horizontal plane of the board, except for a narrow portion at this very outer edge. This raised edge may be routed into the board, or (referring to the prior art frame shown in FIG. 3) a firring strip 240 may be affixed by nails 241 or glue onto the upper surface of the stretcher board 242. However, this method is impractical for canvases shaped in non-rectilinear forms, such as circles, ovals and like curvilinear outlines. These canvases usually are mounted on sheets of plywood which previously have been cut into the desired shape. Precisely-curved firring strips are unavailable (insofar as wood does not readily bend), and plywood mounting panels are not easily routed. On the other hand, while one would be able to paint with the canvas mounted directly on the top surface of the mounting panel without leaving such trace marks, painters usually prefer the spring of stretched free canvas.

Prior developments in this field may be generally illustrated by reference to the following information disclosure statement:

| U.S. Pat. No. | Patentee | Issue Date |
|---|---|---|
| 3,830,278 | L. Packer | Aug.20,1974 |
| 5,133,140 | J. Frey | Jul. 28, 1992 |
| 2,456,225 | C. Thomas | Dec. 14, 1948 |
| 4,947,561 | T. Delacroix et al. | Aug. 14, 1990 |
| 5,115,584 | R. Lucchetti | May 26, 1992 |
| 4,991,329 | W. Wilson | Feb.12, 1991 |
| 4,279,087 | A. Crawford | Jul. 21, 1981 |
| 4,179,830 | T. Lamb | Dec. 25, 1979 |

U.S. Pat. No. 3,830,278 teaches an extruded edging 11 for a canvas, the edging having an L-shaped cross section. Separate corner pieces are attached to the edging after it has been stretched across the frame, to secure the canvas in a rectilinear configuration.

U.S. Pat. No. 5,133,140 teaches a channel molding for a canvas frame that fits around the edges thereof and has pointed barbs with which to secure the canvas.

U.S. Pat. No. 2,456,225 teaches L-shaped angle irons 4 for a canvas frame which grip the canvas with pointed tongues.

U.S. Pat. Nos. 4,947,561 and 5,115,584 teach extruded frame edgings having complex, longitudinally rigid, cross sections for use in making frames comprising rectangles and like rectilinear polygons. The rest of the patents are representative of what was found in the art.

The prior art devices are designed not to bend lengthwise laterally (from side-to-side) to follow the shape of edge of the frame, which is assumed in said devices to be straight, except for angled corners.

Therefore, for use with canvases having curved edges, there is a need for an edging device that is designed to bend easily laterally along its longitudinal axis during its application to the backing board or frame, yet, on the other hand, that is designed to resist lateral deformation from top to bottom when pulled inwardly by stretched canvas.

To avoid confusion between the two types of lateral stability (horizontal and vertical), hereinafter, the tendency of a device to resist or allow lateral deformation along its longitudinal axis will be called "longitudinal" stability or flexibility, respectively, and the tendency of a device to resist or allow lateral deformation within vertical planes passing perpendicularly through its longitudinal axis will be called "upright" stability or flexibility.

SUMMARY OF THE INVENTION

The present invention is an extruded or molded longitudinally pliable plastic edging strip which may be affixed by nails, staples, tacks, glue, or like fasteners, to the side of the outer edge of a shaped plywood board (or like back mounting panel). The thin cross section of the planar strip allows it to bend along its longitudinal axis and to follow the curved edge of the shaped backing. Suitably-shaped injection molded thrust-support brackets vertically placed at spaced intervals help stiffen the edging strip against the inwardly-directed force of the stretched canvas. Once in place, canvas or like fabric may be stretched over the edging strip apparatus so as to lie in a horizontal plane that is vertically separated from the horizontal plane of the backing panel, whereupon the canvas will not contact the backing panel.

Alternately, the cross section of the edging strip can be extruded in a shape which inherently resists inward deformation, so that the need for separate brackets is eliminated.

FEATURES AND ADVANTAGES

An object of this invention is to disclose an edging strip apparatus for an artist's canvas frame having a single back mounting panel or having stretcher bars (i.e., multiple mounting panels). The strip includes a longitudinally flexible body and means for maintaining the body substantially uprightly rigid when the body is bent longitudinally and fixed to a curvilinear section of the mounting panel or of a stretcher bar.

A feature of the preferred strip is that the body is of substantially planar cross section.

Another feature is that the maintaining means preferably is a plurality of thrust-support brackets.

Yet another feature or object is that, preferably, the thrust-support brackets are detachable from the body.

Still other features are posts in the thrust-support brackets and holes in the body, into which holes the posts removably snap.

Another feature is a metal wire running longitudinally through the interior of the bead.

Another object is to disclose an alternate edging apparatus, namely one including a longitudinally extending body of substantially planar cross section, the body having a top edge and a mid-portion; a base plate having proximal and distal ends, the proximal end of the base plate attached to the body perpendicular to the plane of the body at the mid-portion thereof, a longitudinal thrust-support plate, the thrust-support plate extending at an acute angle to the plane of the body downward from the top edge of the body to the distal end of the base plate; and a longitudinally extending channel formed by the plates and body.

Another feature is an apparatus that is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof. References in the singular tense include the plural, and vice versa, unless otherwise noted. The apparatus is uniformly drawn and described herein in the position most convenient for its assembly, namely, with the mounting panel or panels laying horizontally flat. Note, however, that finished paintings normally are displayed vertically on walls, in which case parts described herein as horizontal will become vertical and vertical parts will become horizontal.

DRAWING REFERENCE NUMERALS

Figure 1:
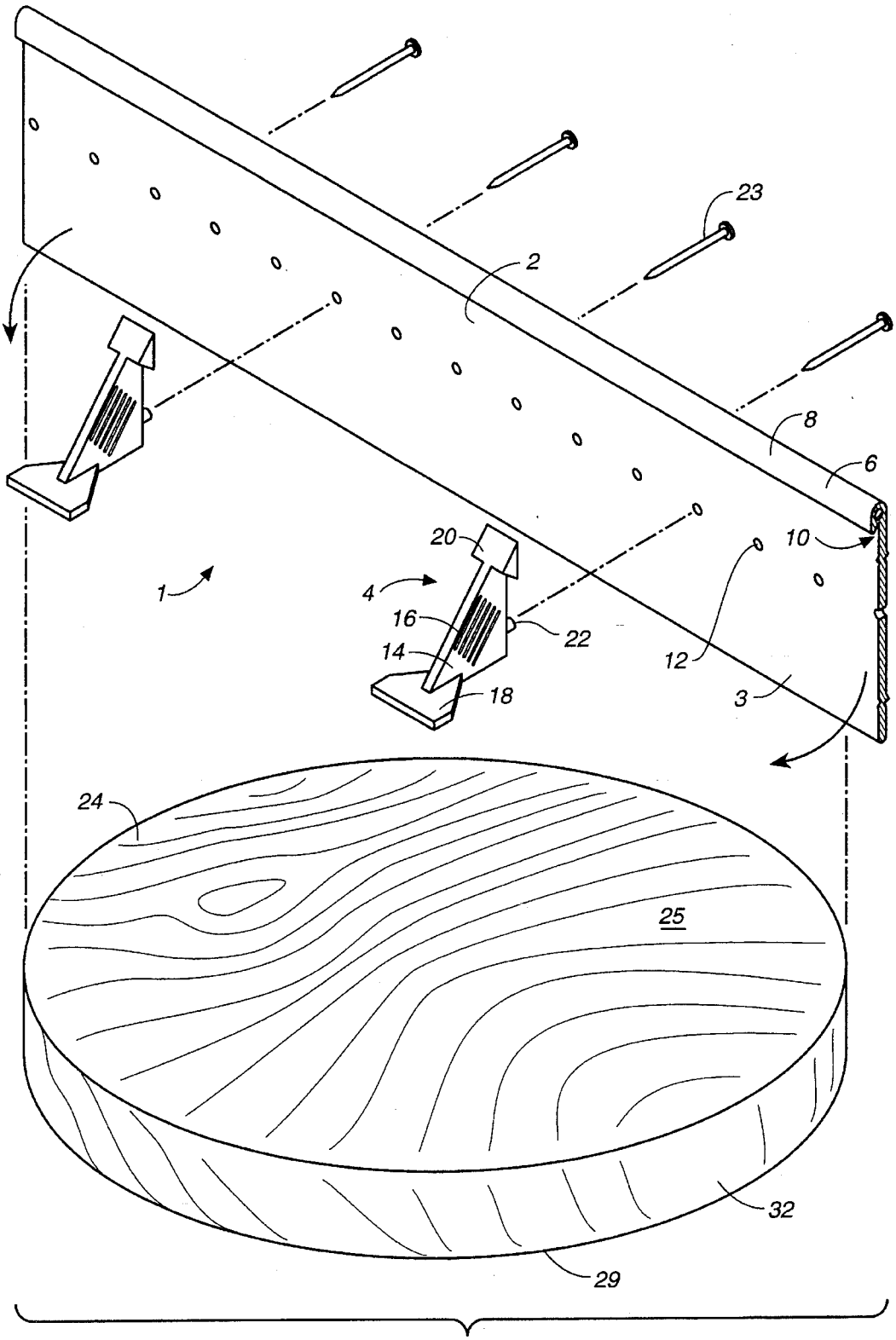
FIG. 1 is an exploded perspective view of the edging apparatus of this invention in a disassembled configuration.

A arrow
B arrow
G gap
1 edging apparatus
2 edging strip
3 body
4 thrust support bracket
6 top edge
8 bead
10 notch
12 hole
14 thrust plate
16 finger grips
18 base plate
20 beveled spline
22 post
23 nail
24 mounting panel
25 top surface
26 seam
27 stretcher frame
28 canvas
29 bottom surface
30 staple
32 edge
34 wire
101 edging apparatus
103 body
106 top edge
108 bead
109 channel
114 thrust plate
118 base plate
123 nail
124 mounting panel
125 top surface
128 canvas
129 bottom surface
130 staple
132 edge
201 edging apparatus
203 body
204 thrust support bracket
214 thrust containment portion
218 base plate
240 firring strip
241 nail
242 stretcher board It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DESCRIPTION OF A PREFERRED EMBODIMENT

Figure 2:
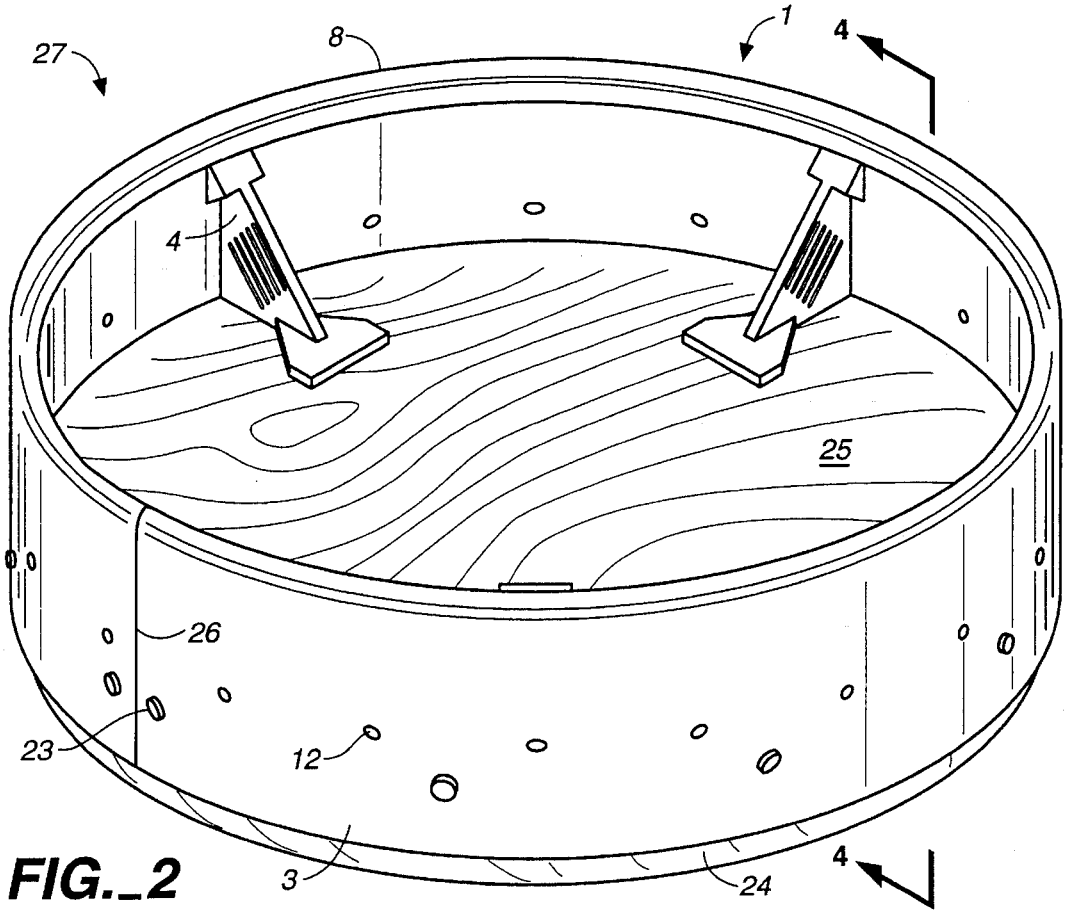
FIG. 2 is a perspective view of the apparatus of FIG. 1 in an assembled configuration.

Referring to FIGS. 1 and 2, there is illustrated therein a preferred edging apparatus 1 of this invention. FIG. 1 shows the apparatus 1 in an exploded disassembled configuration and FIG. 2 shows the same edging apparatus in an assembled configuration. The edging apparatus 1 is principally comprised of a flexible thermoplastic edging strip 2, the strip having an elongated body 3 of substantially planar cross section (i.e., it is I-shaped when viewed on end) which is normally oriented vertically ("upright") during assembly, and of a plurality of rigid thermoplastic thrust-support brackets 4.

Preferably, the substantially planar body 3 has a rounded bead 8 formed along its top edge 6. An upwardly canted notch 10 is formed in the lower inner surface of the bead, at the inwardly-facing side of the strip 2. The bead 8 and notch 10 preferably are formed during the process of extruding or injection-molding the strip 2. A series of regularly spaced holes 12 are punched laterally through the body 3 of the strip.

The thrust-support brackets 4 each have a central thrust-containment portion comprised of a vertical planar thrust plate 14, which plate may have a series of ridges or finger grips 16 formed on the sides thereof. Preferably, the thrust plate 14 is generally triangular in shape, tapering outwardly from top to bottom. At the lower portion of the vertical thrust plate 14 is an inwardly-directed horizontal base plate 18. At the top portion of the thrust plate is a slightly enlarged beveled spline 20 that is shaped to fit snugly within the notch 10 of the bead 8. Projecting outwardly from the thrust plate 14 is a post 22 shaped to snap snugly within any hole 12 of the body 3. The thrust support brackets 4 comprise means for maintaining the body 3 substantially uprightly stable or rigid when the body is bent longitudinally and fixed to a curvilinear section of the edge of the mounting panel 24 or, alternatively, fixed to a curvilinear stretcher bar.

To assemble the edging apparatus 1 in a position (FIG. 2) ready for stretching canvas, cloth or like fabric, first the longitudinally flexible edging 1 is attached by nails 23 to the edge 32 of a back mounting panel 24. The panel 24 previously has been cut into the aesthetically-pleasing curvilinear shape which the artist desires the canvas of the painting to assume when stretched. The mounting panel 24 may be made of plywood, plastic or like rigid planar material. Provided that the strip 2 previously has been cut to the size of the perimeter of the mounting panel 24, one end of the strip 2 will abut against the other end thereof, forming a closed seam 26. Alternatively, more than one edging strip may need to be used. Indeed, the longitudinally pliable strips 2, intended to be bent to fit curved sections of the mounting panel, may be combined with the longitudinally rigid edging apparatus 101 of the alternate embodiment (discussed in connection with FIGS. 5 and 6, below), which latter apparatus 101 is designed for straight-edge panel sections.

Next, a plurality of thrust-support brackets 4 are snapped into place at regular intervals along the strip, by grasping the thrust plates 14 about the finger grips 16 and forcing the beveled splines 20 into the notch 10 and the posts 22 into the holes 12. The base plates 18 are designed to fit flush against the horizontal upper or top surface 25 of the panel 24.

Figure 3:
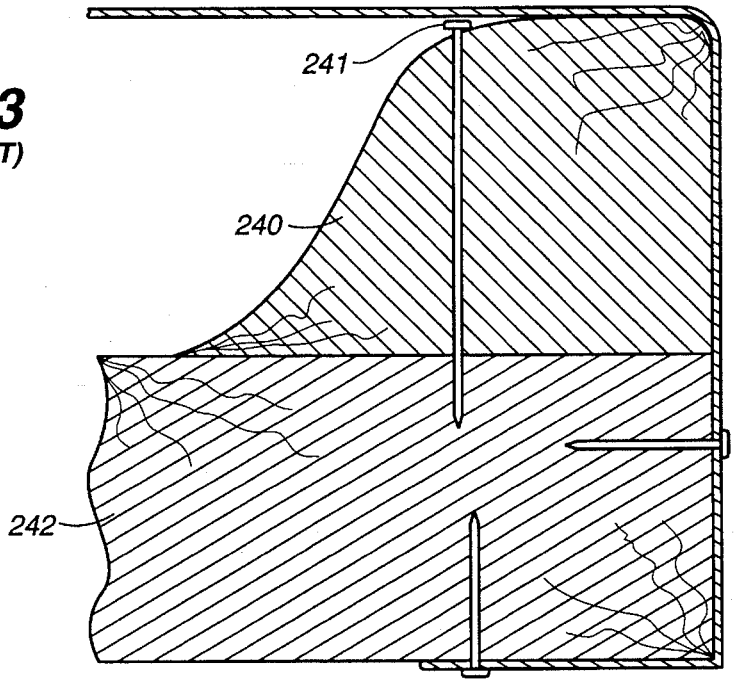
FIG. 3 (PRIOR ART)
FIG. 3 is a broken sectional elevation of a prior art canvas frame.
Figure 4:
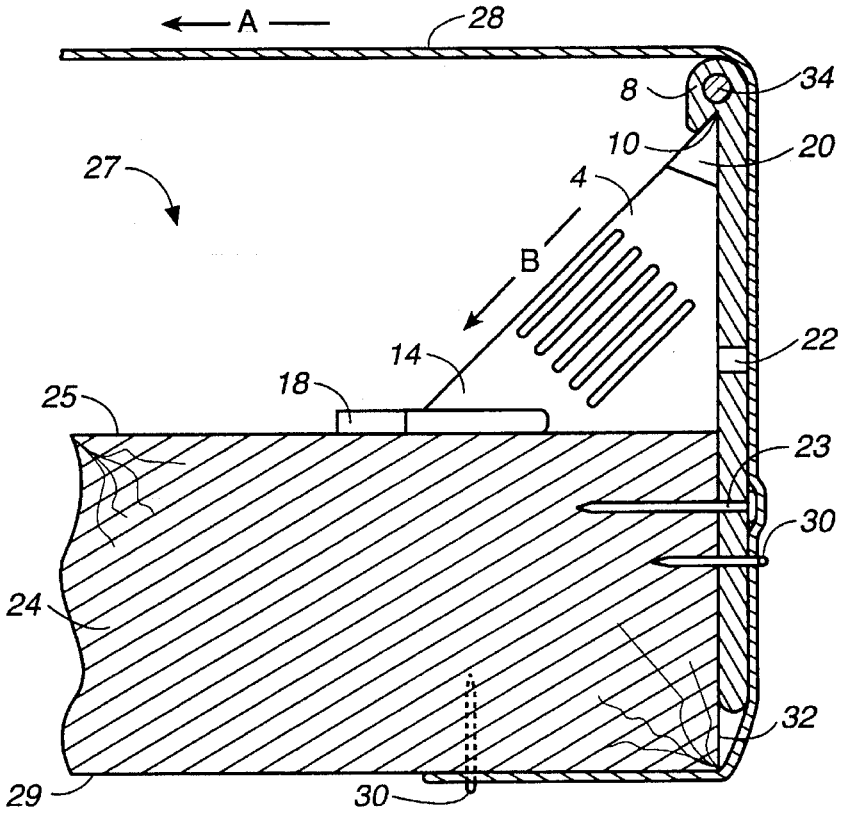
FIG. 4 is a broken sectional elevation of the apparatus of FIG. 1, taken along line 4—4 of FIG. 2.

Turning to FIG. 4, a stretcher frame 27 is formed by stretching a pre-cut canvas 28 tautly over the upper perimeter bead 8 of the edging strip 2 of the pre-fastened edging apparatus 1, down the outside of the body 3 of the strip, and inwardly around the lower perimeter of the horizontal bottom surface 29 of the mounting panel 24. Staples 30, or like conventional fasteners, are used to affix the canvas 28 to the bottom 29 and edge 32 of the mounting panel. As in common and well-known in the framing art, the single mounting panel 24 shown in cross-section in FIG. 4 could be replaced with a plurality of interconnected mounting panels (stretcher bars or boards) having the same cross-section (e,g., stretcher board 242 of FIG. 3).

As can be seen in FIG. 4, force contained within the taut stretched canvas 28 will pull against the edging apparatus 1 in the direction of arrow A. This will be translated into a force directed along the line of arrow B within the thrust plate 14 of the thrust support bracket 4 and distributed through the base plate 18 along the top surface 25 of the rigid back mounting panel 24. Provided that the thrust brackets are spaced at sufficiently close intervals, this redistribution of force will prevent the canvas tension from distorting the body 3 of the strip 2 out of its vertical plane (providing "upright rigidity"), so as not to distort the perimeter of the painting from that desired by the artist. However, for additional support along the top of the edging strip (where the tendency toward inwardly-directed upright distortion will be the greatest), a relatively stiff, yet somewhat malleable, metal wire 34 optionally may be provided throughout the longitudinal extent of the center of the bead 8.

Figure 5:
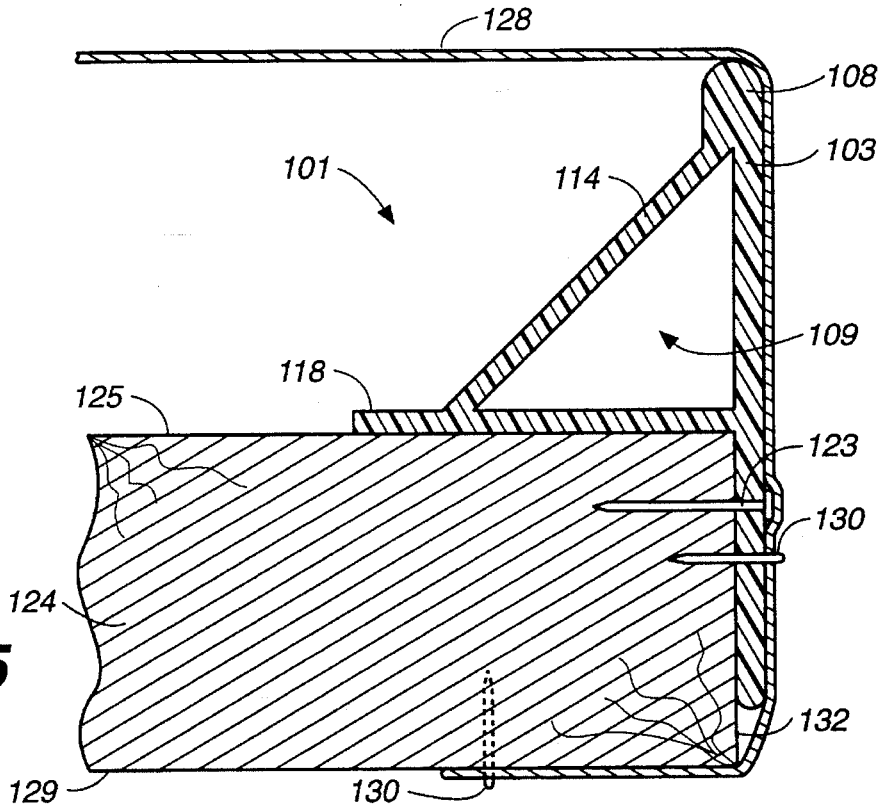
FIG. 5 is a broken sectional elevation view of an alternate embodiment of the edging strip of this invention.
Figure 6:
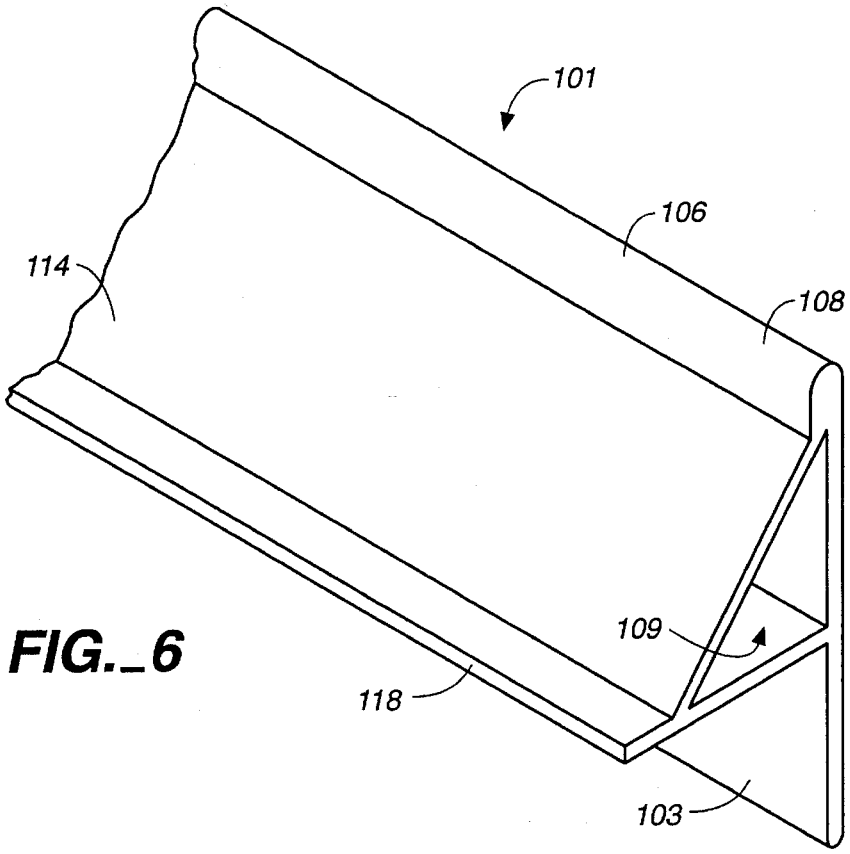
FIG. 6 is a broken perspective elevation of the edging strip of FIG. 5.

An alternate or additional preferred embodiment of the invention is illustrated in FIGS. 5 and 6, namely edging apparatus 101. Unlike the previous embodiment, the edging apparatus 101 is designed to be both uprightly rigid and longitudinally rigid. It is suitable, therefore, only for straight frame edges or portions thereof. The apparatus 101 has an elongated outer body panel 103 of generally planar cross section (normally vertically oriented during assembly). In replacement for thrust-support brackets, it contains an integrated, downwardly and inwardly canted, longitudinal thrust support plate 114 and a horizontal base plate 118. The base plate 118 extends inward from the mid-portion of the body 103 and lies perpendicular to the plane of the body.

Preferably, the planar body 103 has a rounded bead 108 formed along its top edge 106. The bead 108 and plates 114 and 118 preferably are formed during the process of extruding the apparatus 101. A longitudinally extending closed-perimeter inner channel 109 should be formed between the body and the plates during extrusion, to conserve material which is not needed for thrust support.

To assemble the edging apparatus 101 in position for stretching canvas (FIG. 5), first the edging 101 is attached by nails 123 to a straight (rather than curved) portion of a back mounting panel 124. The base plate 118 is designed to fit flush against the horizontal upper or top surface 125 of the panel 124. Next, a pre-cut canvas 128 is stretched tautly over the upper perimeter bead 108 of the pre-fastened edging apparatus 101, down the outside of the body 103, and inwardly around the lower perimeter of the horizontal bottom surface 129 of the mounting panel 124. Staples 130, or like conventional fasteners, are used to affix the canvas 128 to the bottom 129 and edge 132 of the mounting panel.

Figure 7:
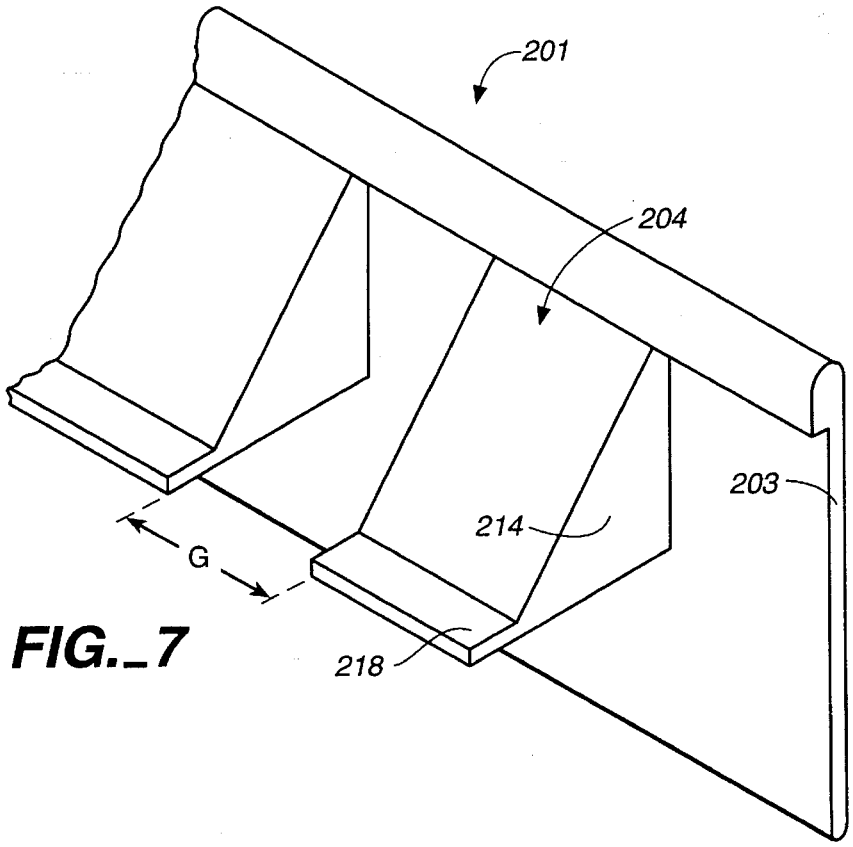
FIG. 7 is a broken perspective elevation of a second alternate embodiment of the invention.

FIG. 7 illustrates a second alternate embodiment of the invention, namely, edging apparatus 201. Apparatus 201 is an edging strip having integrated therein alternate means for maintaining the body 203 substantially uprightly rigid when the body is bent longitudinally and fixed to a curvilinear section of the mounting panel or of a stretcher bar, namely, a plurality of regularly spaced thrust-support brackets 204. Brackets 204 preferably are formed continuously and simultaneously with the longitudinally flexible body 203—for example, through an injection molding process. Alternatively, the brackets 204 may be glued or heat-welded permanently into place after extrusion of the body 203.

Each bracket 204 has a lower horizontal base plate 218 projecting laterally inward from the body 203, which base plate will mate flush with the upper surface of a mounting panel (not illustrated) and redistribute thrust in the form of canvas tension from the body 203 to the mounting panel, via the intermediate thrust-containment portion 214 of the bracket 204.

In use, as the body 203 is bent longitudinally to fit a curvilinear edge portion of the mounting panel, the gaps G between adjacent brackets 204 will shrink or enlarge in size (i.e., taper inwardly or outwardly, depending on whether the edge is concave or convex) at their inner ends. The gaps G (together with the rigid thrust-support brackets 204 and longitudinally-pliable planar body 203) thus allow the apparatus 201 to remain longitudinally flexible, yet uprightly rigid.

While the above provides a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like. Therefore, the above description and illustrations should not be construed as limiting the scope of the invention, which is defined by the appended claims.

What is claimed is:

1. Edging apparatus, for use in the environment of an artist's canvas frame having one or more back mounting panels, including:

a longitudinally flexible body of substantially planar cross section; and means for maintaining the body substantially uprightly rigid when the body is bent longitudinally and the body is fixed to a curvilinear section of a mounting panel, wherein the maintaining means is a plurality of thrust-support brackets.

2. The apparatus of claim 1 wherein:

the thrust-support brackets are detachable from the body.

3.The apparatus of claim 2 further including:

posts in the thrust-support brackets; and holes in the body, into which holes the posts removably snap.

4. The apparatus of claim 2 further including:

a curved longitudinal bead on a top edge of the body, the bead forming a notch in its lower inner surface; and a beveled spline on each of the thrust-support brackets configured to mate with the notch.

5. The apparatus of claim 4 further including:

a metal wire running longitudinally through the interior of the bead.

6. The apparatus of claim 1 further including:

a base plate on each thrust-support bracket, the base plate attached or attachable to the body perpendicular to the plane of the body.

7. The apparatus of claim 1 wherein:

the thrust-support brackets are permanently affixed to the body with gaps being formed between them.

8. The apparatus of claim 7 further including:

a base plate on each thrust-support bracket, the base plate attached to the body perpendicular to the plane of the body; and a curved longitudinal bead on a top edge of the body.

9. Edging apparatus, in combination with an artist's canvas frame having at least one back mounting panel, including:

a longitudinally flexible body of substantially planar cross section; and a plurality of thrust-support brackets attached or attachable to the body and maintaining the body substantially uprightly rigid, the body being bent longitudinally and fixed to a curvilinear section of the at least one mounting panel.

10. The apparatus of claim 9 further including:

posts in the thrust-support brackets;

holes in the body, into which holes the post removably snap;

a curved longitudinal bead on a top edge of the body, the bead forming a notch in its lower inner surface; and a beveled spline on each of the thrust-support brackets configured to mate with the notch.

11. The apparatus of claim 10 further including:

a base plate on each thrust-support bracket, the base plate attachable to the body perpendicular to the plane of the body; and a metal wire running longitudinally through the interior of the bead.

12. The apparatus of claim 9 wherein:

the thrust-support brackets are permanently attached to the body.

13. Edging apparatus for an artist's canvas frame including:

a longitudinally extending body of substantially planar cross section, the body having a top edge and a mid-portion;

a base plate having proximal and distal ends, the proximal end of the base plate attached to the body perpendicular to the plane of the body at the mid-portion thereof;

a longitudinal thrust-support plate, the thrust-support plate extending at an acute angle to the plane of the body downward from the top edge of the body to the distal end of the base plate; and a longitudinally extending inner channel formed by the plates and body.

* * * * *